United States Patent [19]

Butler

[11] 4,039,351

[45] Aug. 2, 1977

[54] CONTAINER WASHER ATTACHMENT

[76] Inventor: Calvin J. Butler, Rte. 2, Box 100, Bend, Oreg. 97701

[21] Appl. No.: 615,832

[22] Filed: Sept. 22, 1975

[51] Int. Cl.[2] ..... B08B 3/02; B08B 9/08

[52] U.S. Cl. ..... 134/102; 134/167 R; 134/177

[58] Field of Search ..... 134/166 R–169 R, 134/171, 175, 177, 201, 102

[56] References Cited

U.S. PATENT DOCUMENTS

| | | | |
|---|---|---|---|
| 2,845,934 | 8/1958 | Payson | 134/169 R X |
| 2,910,077 | 10/1959 | Blake et al. | 134/182 X |
| 3,276,694 | 10/1966 | Alexander | 134/169 R X |
| 3,916,924 | 11/1975 | McGowan | 134/168 R X |
| 3,918,605 | 11/1975 | Butler | 220/63 R |

*Primary Examiner*—Robert L. Bleutge
*Attorney, Agent, or Firm*—Kolisch, Hartwell, Dickinson & Stuart

[57] ABSTRACT

A removable washer attachment providing a closed system for use in washing containers such as chemical or pesticide drums including an insert secured to a formed opening in one wall of the container. The insert has a first portion extending exteriorly of the container, a second portion depending interiorly of the container, and a bore extending axially therethrough for receiving a suction tube. The insert is fluid-tight sealingly engaged with the formed opening. Another seal is provided between the bore and a suction tube inserted therein. When it is desired to wash material from a container, washing fluid is admitted into the bore and is channeled through passages into curved notches disposed in a lower segment of the interiorly depending portion. The washing fluid is sprayed upwardly and contacts the inside top and side walls of the container or a disposable bag if the container utilizes such. Residue material is washed downwardly to the bottom of the container where it is removed through the suction tube.

1 Claim, 4 Drawing Figures

CONTAINER WASHER ATTACHMENT

BACKGROUND OF THE INVENTION

A. Field of Invention

The present invention relates to apparatus for washing containers such as drums or barrels used to store caustic or toxic chemicals, and more particularly to a washer attachment to be used with such a container for providing a completely closed system during a washing operation.

Pesticides and other caustic materials are stored in containers ranging from small one gallon cans up to large fifty gallon drums. After the contents of a container have been used, for instance in the spraying of crops, there is inevitably a residue of pesticide material retained within the container. For example, one study has indicated that unwashed containers have a minimum of 6 to 16 ounces of chemical residue therein. Many states have provided for pesticide laws which require that pesticide containers be completely washed before they can be reused. For example, the EPA requires a triple wash on pesticide containers that are to be reclaimed. It may also be required that the washing operation take place in a closed system, i.e., a system in which residue waste or pesticide material cannot escape into the environment during a washing operation. Escape of residue pesticide material into the environment could involve hazardous human contact as well as unnecessary pollution to the environment. Thus, it becomes readily apparent that a container washing system which prevents escape of pesticide residue is required.

Another problem exists in providing a washer attachment adaptable to both large and small pesticide containers. Large drums often have formed openings in a top portion thereof provided with threads. Smaller containers, however, often employ an extendible-retractable plastic pour spout. Such a spout is used because small containers can be manually lifted and tilted to enable material to be poured from the spout. It is preferable to use the same washing device to clean both types of containers, but different formed openings in the containers make an adaptable washer attachment necessary.

The present invention contemplates the use of a washer attachment adapted for insertion into a formed opening in a large drums (30–50 gal.) or into a cut-away pour spout in small containers (1–5 gal.). The insert has a bore extending substantially axially therethrough for receiving a suction tube sealingly engaged therein. The suction tube depends interiorly of the container and is connected to a suction pump which provides a partial vacuum for removing residue pesticide material. An inlet opening formed in an outer wall of the exterior portion of the insert permits a washing fluid to be pumped under pressure therethrough to the bore region surrounding the inserted suction tube. The washing fluid is directed through passages into a plurality of notches which direct the washing fluid in a spray upwardly against the interior top wall of a container and outwardly against the side walls. It is also contemplated that the present invention could be readily used to wash a disposable bag or liner which is arranged interiorly of the container. In addition, the present invention provides for an air inlet to prevent collapse of a disposable bag or the container when a partial vacuum is created therein during operation of a suction pump.

B. Description of the Prior Art

Prior attempts to provide a container cleaning apparatus have been proposed, and a typical example is set forth in U.S. Pat. No. 2,910,077. This patent discloses an apparatus for cleaning containers and more particularly for cleaning large gallon drums of the type commonly used in the distribution of petroleum products. Cleaning fluid under pressure is discharged by a pump for delivery to an inserted elongated tube having a plurality of nozzles for directing the pumped fluid outwardly onto the side and top walls of the container. An inner suction tube is disposed interiorly of the aforementioned tube for removing residue material. It is apparent that this patent does not provide for a washer attachment which may be sealingly engaged with an opening in both large drums and openings cutaway in plastic extendible-retractable pour spouts of small containers.

Another prior art patent of relevant interest is U.S. Pat. No. 2,965,308, which discloses a tank adapter kit which locates a pipe or tube within a tank for transporting a fluid into an interiorly located spray ball for cleaning the tank. This patent does not suggest the use of a washer attachment which may be sealingly engaged with a formed opening in a large tank or sealingly engaged with a cut-away plastic extendible-retractable pour spout.

In U.S. Pat. No. 2,896,643, there is described cleaning equipment used to clean large barrels or drums by means of flushing out the interior of the drum with a solvent. The solvent is introduced through a hose at the top of a drum, and a separate suction tube is disposed through another hole in the top of the drum for removing residue. A single pump is used to spray solvent into the drum and also to provide partial vacuum for removing waste material mixed with the introduced solvent.

A further prior art patent to be considered in U.S. Pat. No. 3,564,584 which sets forth a machine to be used for washing beer kegs and similar containers. A head is arranged to be attached to an opening on the container for the supply of washing liquid thereto. A control device is connected to a liquid detector which is in communication with an outlet passage so that adequate washing can take place. While this patent discloses an elongated washing tube sealed in relationship with a keg opening, the cleaning device is not adaptable to pesticide drums of varying sizes because of its specialized configuration.

The following U.S. Pat. Nos. are noted and are deemed to be relevant, but do not appear to require further comment at this time: 1,552,998, 2,387,324, 2,240,227, 2,933, 093 and 3,046,163.

SUMMARY OF THE INVENTION

The present invention provides a removable washer attachment adapted for use on large containers or drums having a formed opening therein and also for use on small containers having extendible-retractable plastic pour spouts for being sealingly engaged in either type of opening during a washing operation. The present invention utilizes an insert having a bore extending substantially axially therethrough which extends through a formed opening in one wall of the container. The insert is sealingly engaged with the formed opening and has a first portion extending exteriorly of the container and a second portion depending interiorly of the container. A suction tube may be extended through the bore of the insert for placement interiorly of the container. The suction tube is sealingly engaged with the bore to provide a fluid-tight seal about the suction tube in the bore to prevent discharge of a washing fluid introduced into the bore from being dispersed into the atmosphere or a surrounding environment. A closed washing system is thereby provided.

Arranged on the exterior extending portion of the insert is an inlet for admitting a washing fluid into the bore under pressure. The washing fluid is then directed downwardly through the bore into the interiorly depending portion for subsequent displacement through a plurality of passages into a plurality of notches for directing the cleaning fluid upwardly in a spray. After the interior portion of a container has been sprayed, a suction pump produces a partial vacuum within the suction tube and the interior of the container to draw up residue pesticide material and the washing fluid for removal from the container. A washing operation may be repeated if desired.

It is an object of the present invention to provide a washer attachment adaptable to be sealingly engaged within a formed opening in both small and large containers so that escape of residue pesticide material does not occur. Aligned with this object is the additional object of providing a sealed suction tube within the washer attachment to prevent discharge of washing fluid or residue pesticide material into a container surrounding environment.

Another object of the present invention is to provide a washer attachment in which a washing fluid may be directed in a spray upwardly and outwardly of an interiorly depending portion of the washer attachment so that an interior top wall and side walls of a pesticide container are completely washed with a relatively small washing fluid pressure.

A further object of the present invention is to provide a washer attachment which may be readily and economically manufactured and which may also be used to remove residue material from disposable bags arranged interiorly of a pesticide drum.

Additional objects of the present invention reside in the specific construction of the exemplary embodiment hereinafter particularly described in the specification and shown in the several drawings.

BRIEF DESCRIPTION OF THE DRAWINGS

Novel features of the improved washer attachment in accordance with the present invention will be more readily understood from a consideration of the following description taken together with the accompanying drawings, in which a preferred adaptation is illustrated with the various parts thereof identified by suitable reference characters in each of the views, and in which.

DETAILED DESCRIPTION OF THE INVENTION

Figure 1:
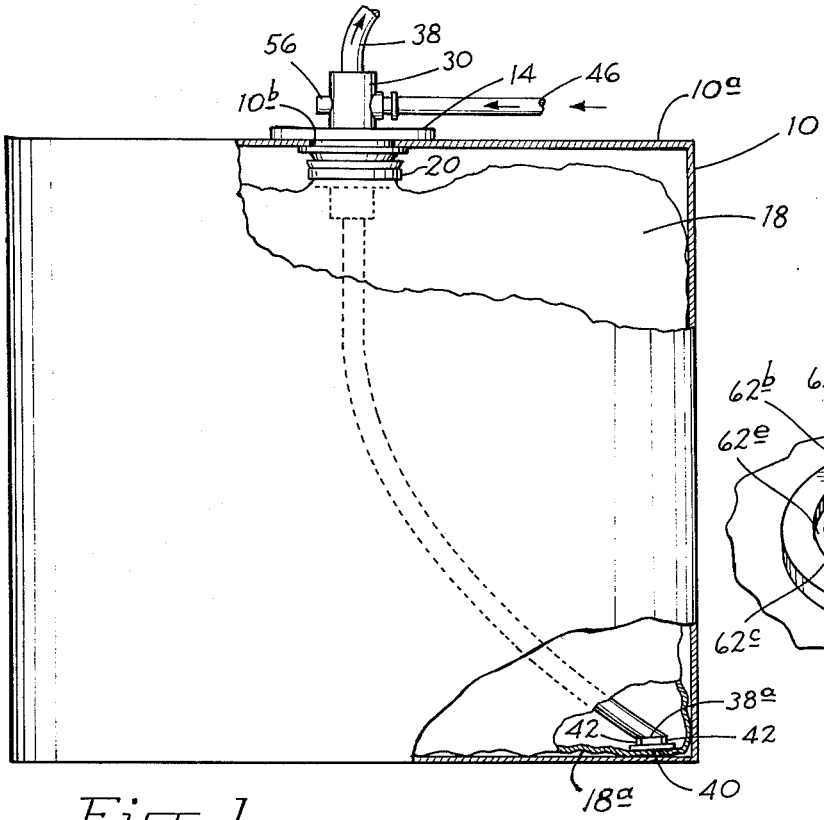
FIG. 1 is a view illustrating a large container, or drum, partially cut away to show an inserted suction tube and the washer attachment of the present invention is disposed within the container.
Figure 2:
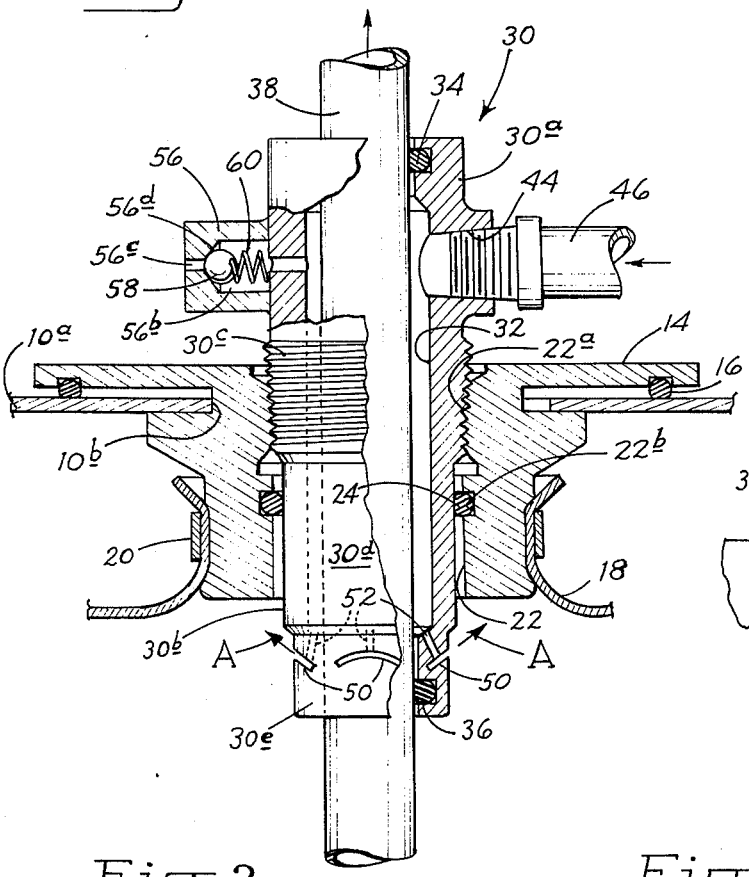
FIG. 2 is a more detailed, enlarged partially cut away view of the washer attachment showing it secured to a container adapter.

Referring initially to FIGS. 1 and 2 of the drawings, at 10 is indicated generally a container having an upper wall **10*a* in which is formed an opening 10*b*. An adapter 14 constructed generally as illustrated and described in applicant's pending U.S. patent application Ser. No. 460,692, now U.S. Pat. No. 3,918,605, entitled "Combination Container With Disposable Closure and Liner Assembly" is secured in opening 10*b* with an O-ring seal 16 providing a fluidtight seal between the adapter and container. The neck of a container liner, or bag, 18 is secured to adapter 14 within the container by a clamp 20. Adapter 14 has a bore 22 extending therethrough which has threads 22*a* formed therein and an annular channel 22*b* in which is mounted an O-ring seal 24.**

The washer attachment includes an elongate, generally cylindrical insert 30 including a first, or upper, portion **30*a* extending exteriorly of the container and a second, or lower, portion indicated generally at 30*b* depending interiorly of the container. A portion of insert 30 intermediate upper and lower portions 30*a*, 30*b* has threads 30*c* formed thereon for engaging and securing the insert within adapter 14. The lower portion 30*b* includes an upper segment, indicated more specifically at 30*d*, having a cross-sectional area or diameter sufficient to tightly seal against O-ring 24 and a lower segment indicated generally at 30*e*** which has a reduced cross-sectional area, or diameter.

A bore 32 extends substantially axially through insert 30 and has O-ring seals 34, 36 received in annular channels adjacent the upper and lower ends of the bore. As is illustrated in FIGS. 1 and 2, an elongate suction tube 38 may be extended through bore 32 with O-ring seals 34, 36 providing a fluid-tight seal against the outer surface of the tube. The lower end of tube 38 extends to the bottom of the container, or to the bottom of the liner in the container. The lower end **38*a* of the tube has a flat plate 40 secured thereto and spaced a predetermined distance therefrom by rigid support posts 42 so that material in the container may be drawn inwardly through suction tube 38, without flexible liner bottom 18*a*** being drawn into the tube, thus to maintain proper suction action for the tube.

A threaded bore, or inlet port, 44 in first portion **30*a* of insert 30 directly communicates with bore 32 for admitting a washing fluid into the bore. A hose 46 may be secured to the inlet port, through which hose washing fluid may be supplied under pressure to the portion of the bore between O-ring seals 34, 36 and surrounding tube 38.**

A plurality of notches 50 are formed in lower segment **30*e*. The notches are cut at an angle to the horizontal so that the open sides thereof are directed somewhat upwardly toward the top wall of the container, or liner. A plurality of passages, or elongated channels, 52 interconnect bore 32 and notches 50 so that washing fluid injected into bore 32 from hose 46 will pass through passages 52 and be sprayed outwardly from notches 50 generally in an upward direction substantially in the direction of arrows A in the form of a spray. The notches are formed in an arcuate shape so that the resulting spray will be dispersed generally in an arc to thereby spray over a larger area. Insert 30** may conveniently be made from cast aluminum anodized for chemical resistance.

An air inlet or bleed valve 56 enables bore 32 to communicate with the atmosphere via passage 56*a*, chamber 56*b* and passage 56*c*. Valve 56 is a ball-type check valve having a ball 58 urged into a normally sealing engagement with a seat 56*d* by a spring 60. The function of valve 56 will be more particularly described below.

Of particular importance to the present invention is the fact that suction tube 38 is sealingly engaged within bore 32 by means of O-ring seals 34 and 36 which prevent discharge of a washing fluid or pesticide material upwardly into the atmosphere or downwardly into the container. Furthermore, it is to be noted that additional O-ring seal 24 which encircles second portion 30*b* prevents residue chemical material from escaping outwardly from bore 22. Such a sealed construction is significant when it is realized that illness to individuals and damage to the environment can occur during a cleaning operation if a proper sealing arrangement is not provided.

Figure 3:
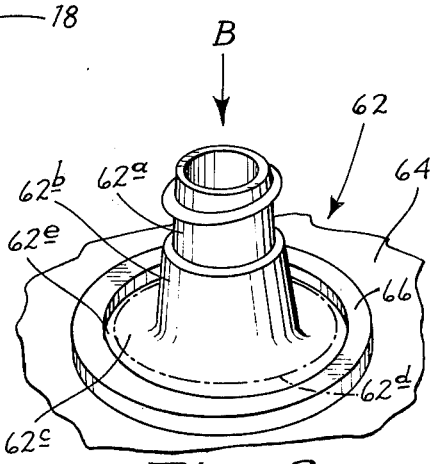
FIG. 3 is an illustration of a typical extendible-retractable plastic pour spout used on small material containers.
Figure 4:
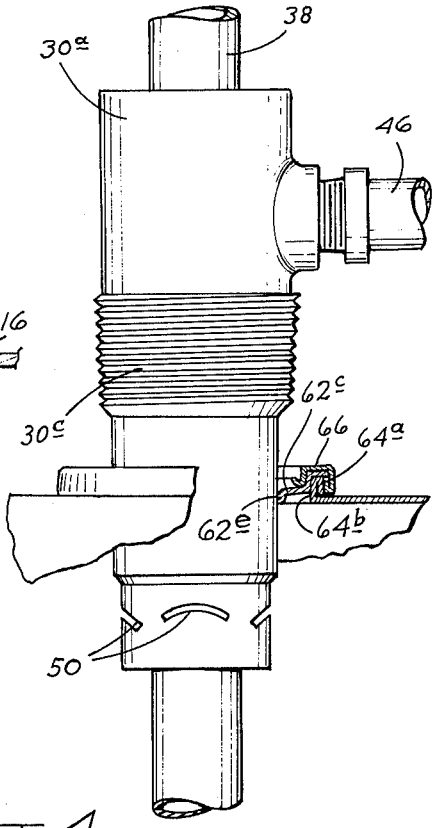
FIG. 4 is a view of the washer attachment of the present invention inserted through a cut-away pour spout.

Referring now to FIGS. 3 and 4, the adaptability of washer attachment insert 30 of the present invention may be more readily appreciated. A typical extendible-retractable plastic pour spout is generally indicated at 62 secured to a formed opening in a small container top, partially shown at 64. Pour spout 62 has an upper tube 62*a* extendible from and retractable into lower tube 62*b*. Lower tube 62*b* is extendible from and retractable into spout surface 62*c*. A rim 66, attaches surface 62*c* to a lip 64*a* of a formed opening 64*b* of container top 64. When tubes 62*a* and 62*b* are depressed in the direction of arrow B to a position below surface 62*c*, it is apparent that a small container will have a relatively flat upper surface to facilitate storage of one container on top of another. When it is desired to pour contents from a small container having a spout as aforedescribed, a lifting ring (not shown) secured to upper tube 62*a* is pulled upwardly to extend retracted tubes 62*a* and 62*b* from a stowed position beneath surface 62*c* interiorly of the container. A pour spout of the type just described is produced by Rieke.

When it is desired to insert the washer attachment for cleaning purposes into a small container employing an extendible-retractable plastic pour spout, a cut made with a sharp instrument along line 62*d* is completed so the plastic portion radially inward of the cut may be discarded. Referring to FIG. 4, it can be seen that washer insert 30 may now be inserted through cut 62*d* for sealed contacting relationship therewith as illustrated. Cut 62*d* defines a lip portion 62*e* which projects radially inwardly from the formed opening in the top of the container and contacts upper segment 30*b* of the depending interior portion of the insert. As shown in FIG. 4, depending interior portion 30*b* may not necessarily be required to be totally disposed interior of a small container as is the case when washer attachment 10 is used in a large container. The reason for this resides in the fact that threaded segment 30*c* is disposed exteriorly of a small container. The aforementioned differing cross-sectional areas of upper and lower segments 30*b* and 30*d* enable a fouling free insertion and withdrawal of notches 50 past lip portion 62*e*. Because notches 50 are disposed inwardly of the exterior wall of upper segment 30*b*, it is apparent that notches 50 will not become impeded or caught on cut 62*d* of lip portion 62*e* during insertion or withdrawal.

OPERATION OF THE WASHER ATTACHMENT

When it is desired to clean residue material from a disposable bag or liner in a pesticide drum, the washer attachment of the present invention may be conveniently used as follows. First, threaded segment 30*c* is helically secured to adapter 14. Suction tube 30 is then inserted downwardly through bore 32 in sealed contact with O-rings 34, 36. End portion 38*a* of the suction tube extends to the bottom of the container and plate 40 rests on the bottom. Before a partial vacuum is applied by means of a pump attached to suction tube 38, a washing fluid is introduced through hose 46 through inlet 44 and downwardly through bore 32. The washing fluid may be water or a chemical solvent, and it is contemplated that water pressure of about 40 psi (garden hose pressure) will adequately and rapidly clean a drum. The washing fluid then passes through passages 52 and outwardly through notches 50 in the direction of arrows A to contact the upper part of disposable bag 18, or, if no disposable bag is used, the upper part of interior portion of container 10. The washing fluid thus contacts an upper surface and the side walls of the container or the disposable bag thereby washing residue pesticide material to a bottom surface 18*a*.

During introduction of a washing fluid, fluid pressure is applied through channel 56*a* to seat ball 58 against its seat 56*d*. After sufficient washing fluid has been introduced, further use of the washing fluid is terminated and an external pump (not shown) connected to suction tube 38 is actuated to draw up the residue pesticide material and washing fluid through suction tube 38 and outwardly to a storage unit. With a partial vacuum being created within disposable bag 18 or container 10, it becomes apparent that introduction of air may be required. Thus, it may be appreciated that with the cessation of the introduction of a washing fluid, and the creation of a partial vacuum within an interior region, ball valve 58 will be disposed somewhat to the right against spring 60 to draw air from the atmosphere down through bore 32 and outwardly through notches 50 to equalize the interior pressure. Thus, collapse of a disposable bag or the container will not occur.

A similar procedure is used to evacuate residue pesticide material from a small container by inserting the washer attachment through a cut-away extendible-retractable plastic pour spout as indicated in FIG. 4. The same washing and suction procedures are applied as outlined above.

While the invention has been particularly shown and described with reference to the foregoing preferred embodiment herein, it will be understood by those skilled in the art that other changes in form and detail may be made without departing from the spirit and scope of the invention as defined in the appended claims.

What is claimed is:

1. A removable washer attachment for use in washing containers comprising:

insert means for extending through a formed opening in a wall of a container in fluid tight sealing engagement therewith, said insert means including a first portion for extending exteriorally of the container, a second portion for depending interiorally of the container and a threaded segment, said threaded segment disposed between said portions and arranged to permit coupling of said insert means to a threaded formed opening in a container, said insert means additionally including a bore extending substantially axially therethrough for receiving a suction tube;

sealing means for producing a substantially fluid tight seal about a suction tube in said bore to prevent discharge of fluid from said bore into the atmosphere;

means for admitting a washing fluid into said bore under pressure including an inlet opening formed in an outer side wall of said first portion spraying means communicating with said bore arranged adjacent to an end of said interiorally disposed second portion, said spraying means including a plurality of arcuately shaped notches arranged to direct washing fluid over an arc for dispersal into the container for washing same, said notches being formed on a segment of said second portion which has a cross-sectional area less than the remainder of said second portion so that said notches will not become fouled against an opening in a container during insertion and withdrawal of said insert means; and an air inlet valve communicating with said bore disposed on said first portion for permitting passage of air therefrom to said bore for subsequent displacement outwardly through said notches as material is withdrawn from a container through said suction tube.

* * * * *